United States Patent [19]

Oexler et al.

[11] Patent Number: 4,653,266

[45] Date of Patent: Mar. 31, 1987

[54] OPEN-END SPINNING APPARATUS

[75] Inventors: Rudolf Oexler; Kurt Veit, both of Ingolstadt, Fed. Rep. of Germany

[73] Assignee: Schubert & Salzer, Ingolstadt, Fed. Rep. of Germany

[21] Appl. No.: 847,291

[22] Filed: Apr. 2, 1986

[30] Foreign Application Priority Data

Apr. 6, 1985 [DE] Fed. Rep. of Germany ..... 3512592

[51] Int. Cl.[4] ..... D01H 7/882; D01H 7/892

[52] U.S. Cl. ..... 57/407; 57/401; 57/406; 57/413

[58] Field of Search ..... 57/401, 404, 406–407, 57/408, 411, 412, 413

[56] References Cited

U.S. PATENT DOCUMENTS

| | | | |
|---|---|---|---|
| 3,874,154 | 4/1975 | Stahlecker et al. | 57/407 |
| 3,972,171 | 8/1976 | Handschuch et al. | 57/406 |
| 4,059,947 | 11/1977 | Stahlecker | 57/407 |
| 4,069,655 | 1/1978 | Stahlecker et al. | 57/407 |
| 4,112,659 | 9/1978 | Stahlecker et al. | 57/407 |
| 4,245,460 | 1/1981 | Staufert et al. | 57/407 X |
| 4,539,807 | 9/1985 | Stahlecker | 57/401 |
| 4,570,435 | 2/1986 | Stahlecker | 57/401 |

FOREIGN PATENT DOCUMENTS 2721386 11/1978 Fed. Rep. of Germany .

*Primary Examiner*—John Petrakes
*Attorney, Agent, or Firm*—Dority & Manning

[57] ABSTRACT

A fiber feed channel of an open-end spinning apparatus is divided by a parting face into a stationary part and a movable part, including a pivoted cover. The parting face includes an elastic O-ring, the surface of which is disposed at a predetermined minimum angle $\alpha$ relative the direction of movement of the pivoted cover. Such orientation ensures a relatively perpendicular component of contact between the O-ring and the pivotal cover, thereby reducing sliding friction between the two which prolongs the life of the O-ring while providing a good seal. Two interacting elements, one arranged on the cover and the other arranged on the spinning element housing, define a stop for positioning the cover relative to the spinning element.

17 Claims, 4 Drawing Figures

OPEN-END SPINNING APPARATUS

Figure 1:
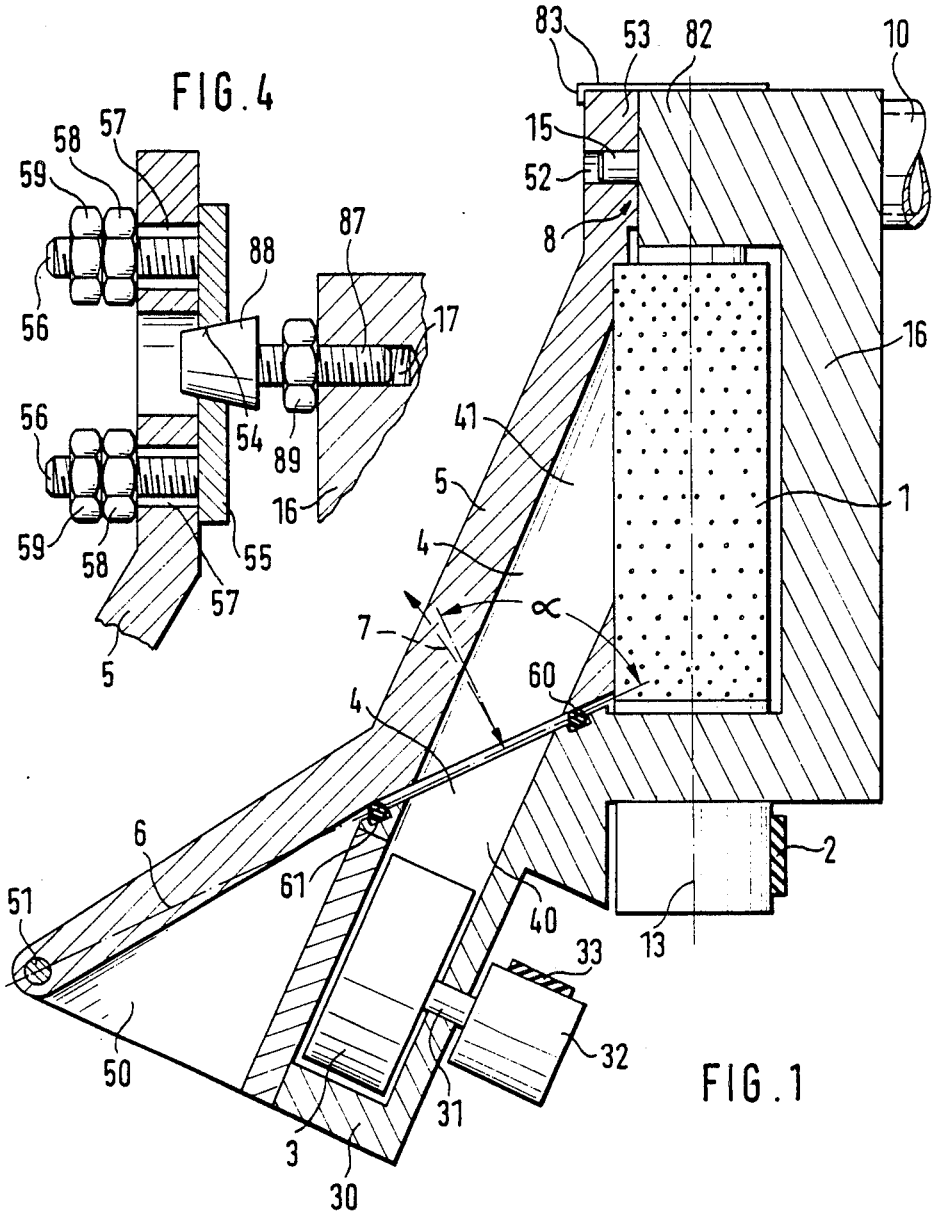

The present invention relates to an open-end spinning apparatus, with a spinning element, an opening-roller housing and a fiber feed channel which leads from the opening-roller housing to a spinning element and which is divided by a parting face into a stationary part and a movable part, and also with a movable cover for the spinning element which receives the movable part of this fiber feed channel.

In a known apparatus of this type, the stationary part of the fiber feed channel is provided in an opening-roller housing which is screwed to the machine frame (German Offenlegungsschrift No. 2,130,688), corresponding to U.S. Pat. No. 3,972,171. The movable part of the fiber feed channel is located in a rotor lid which can be pivoted about a vertical axis into and out of the working position. It thereby slides on the surface of the opening-roller housing forming the parting face of the fiber feed channel. In addition, the lid is guided on its pivot axle in such a way that it covers the rotor housing perfectly. Consequently, it is impossible to obtain a seal between the two length-sections of the fiber feed channel, so that secondary air penetrates into the fiber feed channel.

It is also known to arrange the rotor lid having the movable part of the fiber feed channel on a cover which is pivotable about an axis located underneath the spinning location and extending in the longitudinal direction of the machine (German Patent Specification No. 2,161,619), corresponding to U.S. Pat. No. 3,874,154. To align the lid relative to the spinning rotor, there are next to the fiber feed channel a guide track and a sliding surface which guide the lid concentrically relative to the pivot axis. At the same time, a higher tolerance has to be provided in the region of the parting face of the two parts of the fiber feed channel, so that secondary air enters the fiber feed channel here.

It is known, furthermore, to seal off the separating face of the fiber feed channel by means of an O-ring (German Patent Specification No. 2,721,386). Because the cover is pushed on concentrically relative to the movable part of the fiber feed channel, this O-ring is consequently destroyed very quickly. In this known apparatus, both the cover and the opening-roller housing with the O-ring are therefore each mounted so as to be pivotable about their own axis, and a control by means of a pressure cam is provided, so that, during the closing and opening movement of the cover, the opening-roller housing is pivoted away until the cover can assume its closed position without touching the O-ring, and only in the closed position is the opening-roller housing swung back against the O-ring. This is a very expensive construction because of the pivotable suspension of the opening-roller housing, since all the drives are also affected by such a pivotability, and this has to be taken into account when they are installed. In particular, the difficulty is that, to fasten the pivotable part of the feed channel to the cover, there is a certain amount of overdefinition, in that alignment according to the rotor both in a central and in an axial direction necessarily results in a specific position of the opening-roller housing relative to the connecting-channel portion. The fiber feed channel is then sealed off by moving up the opening-roller housing. Since this in turn has to be fastened to the opening roller in a specific way both relative to the drive of the opening roller and relative to the feed shaft, it can only be moved up in this way in the special case where the feed shaft serves as a pivot point for the opening-roller housing with the opening roller. This makes it necessary to arrange the opening roller in a way which is not always acceptable, and moreover requires an expensive mounting of the opening-roller housing on the feed shaft and, in turn, of the feed shaft in the machine frame.

The object of the present invention is, therefore, to fasten the movable part of the feed channel to the cover exactly relative to the two connecting elements, i.e. the spinning rotor or friction rollers, on the one hand, and the fiber feed channel in the opening-roller housing, on the other hand. In this method of fastening, the sealing off of the channel separating point emerges as a secondary consequential problem.

In the solution according to the invention, there is a stop which consists of two interacting elements, one element being arranged on the cover and the other element being arranged on the housing surrounding the spinning element, for positioning the cover relative to the spinning element, and the fiber feed channel has an elastic parting face which is arranged at an angle $\alpha$ to the direction of movement of the movable part of the fiber feed channel. This ensures, in a simple way, that a single pivoting movement about a single pivot axis makes it possible to open and close the rotor housing or friction-roller housing when the opening unit is stationary. This not only makes the construction considerably easier as regards the mounting of the opening-roller housing and the connection of the drives for the opening roller and feed roller, but also ensures a simple assembly and adjustment of the individual elements relative to one another, this having a positive effect on all the spinning properties of the spinning apparatus.

To achieve a perfect spinning function, it is important to position the mouth of the feed channel relative to the friction rollers or relative to the V-shaped nip accurately to fractions of a millimeter. This is also true of the spinning rotor. According to the present invention, this important fastening is carried out directly opposite the spinning element (friction rollers or spinning rotor), whilst possible differences arising at the separating point of the fiber feed channel are compensated by an elastic parting face. This guarantees both that the part of the fiber feed channel located in the cover is fastened and that the separating point of the fiber feed channel is sealed off. The claimed orientation of the parting face ensures that the movement of the length-section during the time when its end is in contact with the O-ring has a movement component perpendicular to the parting plane. This consequently reduces or completely prevents sliding movements of the lengthsection relative to the elastic parting face, thus resulting in an increase in the service life of the elastic parting face. At the same time, there is no need for a pivotable housing, guide ramp or control for the opening and closing operation, so that an apparatus which is substantially simpler in comparison with the state of the art and which is consequently also cheaper is also obtained.

The elastic parting face can be designed in different ways, for example as an elastic or elastically mounted plate; preferably, one of the parting faces contains an elastic O-ring. The elasticity of the parting face is obtained by means of the O-ring, whilst the surface carrying the O-ring can itself be rigid. Although it is possible, in principle, to provide the elastic parting face either on the stationary part or on the movable part of the fiber feed channel or even on both parts of this channel, it is preferably located on the stationary channel part.

To achieve the best possible fiber transport to the open-end spinning element, a seal is necessary both between the movable part of the fiber feed channel and its stationary part and between the movable part and the housing receiving the open-end spinning element (spinning rotor, friction-spinning elements, etc.). At the same time, because of the customary relative positions of the open-end spinning element and opening-roller housing and the orientation of the fiber feed channel determined as a result, it has proved advantageous if the angle of inclination between the parting face and the direction of movement of the movable length-section is greater than 5°, but no greater than 45°.

In principle, the movable part of the fiber feed channel can be moved in any way relative to the parting face and the stationary part of the fiber feed channel. For reasons of construction, it is especially advantageous if, on an open-end spinning apparatus having a spinning rotor, the cover is pivotable about a pivot axle which extends horizontally in a plane parallel to the collecting-groove plane of the spinning rotor. On an open-end spinning apparatus with two driven friction-spinning elements forming a V-shaped nip, the cover is preferably pivotable about a pivot axis which extends perpendicularly relative to the axes of the friction-spinning elements and parallel to the plane passing through the axes of the two friction-spinning elements.

According to a further feature of the invention, in order to prevent movement components parallel to the parting face completely, it is possible for the cover to be pivotable about a pivot axle which is in the plane of the parting face of the two parts of the fiber feed channel.

Advantageously, the cover has assigned to it a guide bolt which aligns the movable part of the fiber feed channel, during its movement into its working position, relative to the stationary part and parallel to the pivot axle. In this way, the fiber feed channel is positioned exactly relative to the spinning elements, whilst the fiber feed channel is sealed off securely.

In a further embodiment of the invention, an ideal fastening of the cover with the movable part of the fiber feed channel relative to the spinning element or spinning elements and relative to the stationary part of the fiber feed channel is achieved because the stop and/or the guide bolt is located at that end of the cover surface resting against the housing which is turned away from the parting face.

Where a divided fiber feed channel is concerned, the subject of the invention makes it possible, in a simple way, to fasten the movable part of the feed channel perfectly in the cover relative to the connecting elements, i.e. the spinning element (spinning rotor or friction rollers) and relative to the stationary part of the fiber feed channel. Undisturbed fiber transport is achieved as a result, without the opening-roller housing having to be mounted pivotably for this purpose, and without the need for guide ramps between the opening-roller housing and the spinning-unit cover carrying the movable part of the fiber feed channel. Thus, in comparison with the state of the art, a simpler and more robust apparatus which is consequently also less susceptible to faults is provided. Moreover, a long service life of the elastic parting face is obtained, since the movable part of the fiber feed channel, when it runs onto the elastic parting face, has a movement component perpendicular to the parting face.

Figure 2:
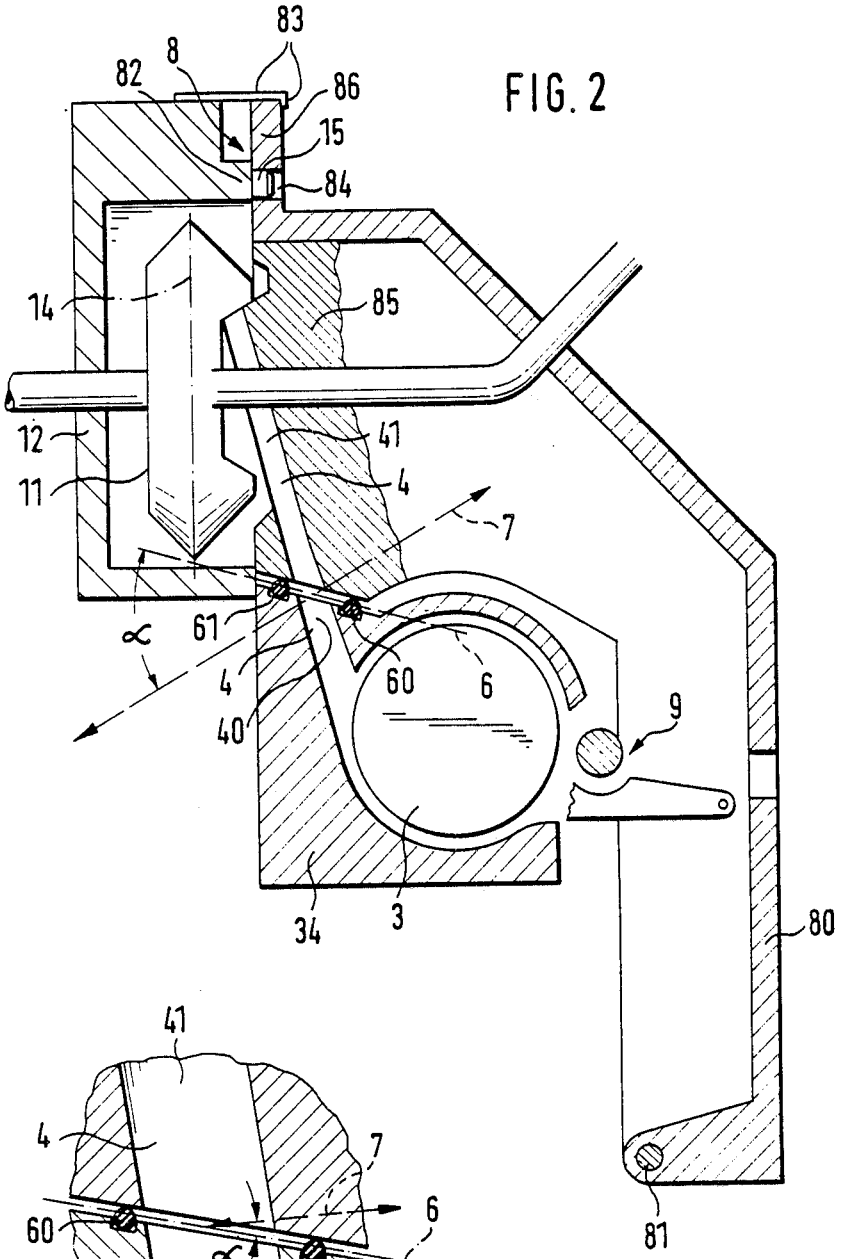
Figure 3:
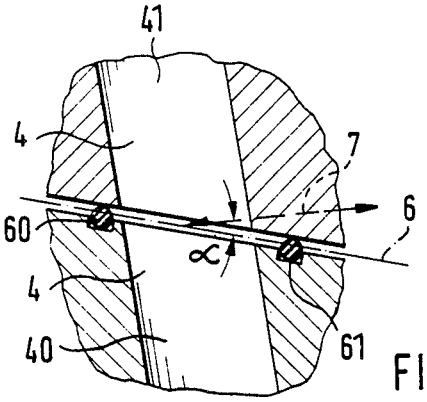

Two exemplary embodiments are described below with reference to drawings, in which FIG. 1 shows, in cross-section, an open-end friction-spinning apparatus designed according to the invention, FIG. 2 shows, in cross-section, a rotor spinning apparatus designed according to the invention, FIG. 3 shows a portion of the fiber feed channel in cross-section, and FIG. 4 shows, in cross-section, a modification of a detail of the apparatus illustrated in FIG. 1.

The open-end friction-spinning apparatus illustrated in FIG. 1 contains two rotationally symmetrical driven friction-spinning elements 1, at least one of which is perforated. In the embodiment shown, this perforated friction-spinning element is designed as a roller. At least the perforated friction-spinning element 1 is connected to a vacuum source via a suction pipe 10.

The two friction-spinning elements 1, of which only one is visible in FIG. 1, are arranged in a housing 16 and are driven in the same direction by a tangential belt 2.

The friction-spinning elements 1 are preceded by a fiber feed device 9 (see FIG. 2) and an opening roller 3. The opening roller 3 rests in a housing 30 and is driven by means of a tangential belt 33 via a wharve 32 located on its axle 31.

A fiber feed channel 4 extends from the opening roller 3 into the V-shaped nip (not shown) between the two friction-spinning elements 1.

So that the V-shaped nip between the friction-spinning elements 1 can be made accessible, without drives of the driven elements having to be detached for this purpose, the fiber feed channel 4 is divided into a stationary part 40 located in the housing 30 of the opening roller 3 and a movable part 41. The movable part 41 is arranged in a pivotable cover 5 which covers the V-shaped nip between the friction-spinning elements 1. The cover 5 is mounted by means of a pivot axle 51 on a carrier 50 attached to the housing 30. At the same time, in relation to the direction of transport of the fiber material through the friction-spinning elements 1, the pivot axle 51 is located in front of these and extends perpendicularly relative to the axles of the friction-spinning elements and parallel to the plane 13 passing through these axles.

The cover 5 together with the movable part 41 of the fiber feed channel 4 can be brought out of the working position shown into a servicing position, in which the V-shaped nip between the friction-spinning elements 1 is freely accessible. The parting face 6 between the two parts 40 and 41 of the fiber feed channel 4 is thereby likewise exposed, so that both the part 40 and the part 41 of the fiber feed channel 4 can be cleaned from here.

Located in the parting face 6 between the two parts 40 and 41 of the fiber feed channel 4 is an O-ring 60 which is mounted in a groove 61 of the housing 30 and which projects somewhat beyond the groove 61.

In the exemplary embodiment illustrated, the parting face 6 is oriented in such a way that the pivot axle 51 for the cover 5 and for the movable part 41 of the fiber feed channel 4 is located in the parting face 6. As a result, the direction of movement (double arrow 7) of the end of the movable part 41 of the fiber feed channel 4 facing the O-ring 60 is directed at an angle $\alpha$ of 90° relative to the parting face 6.

FIG. 1 shows that a stop 8 limiting the movement of the cover 5 is assigned to the cover 5 having the movable part 41 of the fiber feed channel 4. This stop consists of a first element 53 on the cover 5 and of a second element 82 on the housing 16, in order, by means of these, to position the cover 5 and therefore the movable part 41 of the fiber feed channel 4 exactly relative to the friction-spinning elements 1. The cover 5 is locked in its working position by means of a catch 83.

The open-end friction-spinning apparatus works in the conventional way. A sliver (not shown) is fed by means of the abovementioned fiber feed device 9 (FIG. 2) to the opening roller 3 which opens the sliver into individual fibers. The individual fibers pass through the fiber feed channel 4 into the V-shaped nip between the two friction-spinning elements 1. As a result of the rotation of these friction-spinning elements 1, the fibers are tied into the end of a thread which is drawn off continuously in a known way by means of a pair of draw-off rollers (not shown).

When the V-shaped nip between the friction-spinning elements 1 or the parting face 6 of the fiber feed channel 4 are to be made accessible for servicing purposes, this is carried out by swinging the cover 5 down about the pivot axle 51. The chosen relative arrangement of the pivot axle 51 and parting face 6 ensures that the cover 5 together with the movable part 41 of the fiber feed channel 4, during its opening movement (see the direction of movement identified by the double arrow 7), is moved along a plane passing through the fiber feed channel 4 and perpendicularly relative to the parting face 6. Consequently, no sliding movements occur between the cover 5 and the O-ring 60 mounted in the housing 30. As a result, the O-ring 60 has a long service life.

The cover 5, during its closing movement, comes up against the stationary stop element 82 of the housing 16 by means of its stop element 53, thereby fixing the position of the cover 5 exactly relative to the friction-spinning elements 1 arranged in the housing 16. Possible differences arising at the separating point of the fiber feed channel 4 are compensated by the elastic parting face 6. When the movable part 41 of the fiber feed channel 4 is positioned exactly relative to the friction-spinning elements 1, a perfect seal is obtained between the two parts 40 and 41 of the fiber feed channel 4.

The dimensions and elasticity of the O-ring 60 are such that, by undergoing deformation, it absorbs substantially or even completely tangential movement components during the period between the time when the cover 5 and the O-ring 60 come in contact with one another and the time when the cover 5 comes up against the stop 8. Sliding friction between the cover 5 having the movable part 41 of the fiber feed channel 4 and the O-ring 60 is thereby prevented, and this results in a longer service life of the O-ring 60. As illustrated, the O-ring 60 is either embedded in a groove 61 or, alternatively, glued or fastened in another way to a surface ending in the parting face 6.

To adjust the movable part 41 of the fiber feed channel 4 parallel to the plane 13, there is on the housing 16 a guide bolt 15 which engages into a recess 52 in the cover 5. In this case, the movable part 41 of the fiber feed channel 4, in its working position, is sealed off and fixed not only relative to the stationary part 40 of the fiber feed channel 4, but also relative to the housing 16.

It is advantageous if, in contrast to the design illustrated in FIG. 1, the angle $\alpha$ between the parting face 6 and the direction of movement (double arrow 7) of the movable part 41 of the fiber feed channel 4 is greater than 5°, but no greater than 45°. This ensures that the movement of this movable part 41 of the fiber feed channel 4 has a movement component perpendicular both to the parting face 6 and to the parting plane between the movable part 41 of the fiber feed channel 4 and the housing 16 for the friction-spinning elements 1. At the same time, in contrast to the design illustrated, the pivot axle for the cover 5 can also be behind the friction-spinning elements 1 in relation to the material transport direction.

The stop and the guide bolt of FIG. 1 can also be combined with one another, as shown in FIG. 4. According to this Figure, a bolt 87 with a conical head 88 is introduced into a threaded bore 17 provided in the housing 16, the bolt 87 being secured in its particular position by a lock nut 89.

The head 88 engages into a conical bore 54 in a plate 55. This plate carries several threaded bolts 56 which project through bores 57 in the cover 5. On the side of the cover 5 facing away from the plate 55, two counternuts 58 and 59 are screwed onto the threaded bolts 56 and secured relative to one another by locking. The bores 57 in the cover have a larger diameter than the threaded bolts 56, so that the plate 55 can be adjusted transversely relative to the axis of the bolt 87.

The bolt 87 can thus be adjusted in the direction of movement of the cover 5, whilst this plate 55 is adjustable transversely relative to this, in order to align the fiber feed channel 4 parallel to the collecting face (plane 13). This is made possible by appropriate tolerances in the mounting on the pivot axle 51 and/or in the design of the cover 5. Of course, it is also possible to attach both the adjustable plate 55 and the bolt 87 to the cover 5 or even both elements 55 and 87 to the housing 16, and here again it is possible to provide, instead of the bolt 87, a stop 8 and a guide bolt 15 independent of this.

If these adjusting and aligning elements (guide bolt 15/recess 52 and stop 8 or bolt 87) were arranged in the vicinity of the parting face 6, as is possible per se, any tolerances would have an increased effect at the transition point between the fiber feed channel 8 and the friction-spinning elements 1. Consequently, in the design illustrated, the guide bolt 15, the recess 52 interacting with it and the stop 8 are arranged at that end of the surface of the cover 5 resting against the housing 16 which is turned away from the parting face 6. This ensures the best possible adjustment of the cover 5 relative to the housing 16.

FIG. 2 shows, in cross-section, an open-end rotor spinning apparatus with a rotor housing 12 receiving a spinning rotor 11. The rotor housing 12 with the spinning rotor 11 is covered with a lid 85 which is carried by a cover 80 pivotable about a pivot axle 81. The pivot axle 81 is arranged underneath the open-end spinning apparatus and extends horizontally in a plane parallel to the collecting-groove plane 14 of the spinning rotor 11.

The cover 80 covers not only the rotor housing 12 but also the fiber feed device 9 and the housing 34 containing the opening roller 30, from which the divided fiber feed channel 4 extends to the spinning rotor 11. The movable part 41 of the fiber feed channel 4 is arranged in the lid 85 and is taken up when the cover 80 is pivoted.

According to FIG. 2, a stationary guide bolt or guide pin 15, which engages into a corresponding recess 84 in the cover 80, is provided on the rotor housing 12. By means of this guide bolt 15 assigned to the cover 80, the movable length-section 41, during its movement into the working position shown, is aligned relative to the stationary length-section 40 of the fiber feed channel 4 and also relative to the rotor housing 12 both vertically and also parallel to the axle 81. There is also a stop 8, of which one element 82 is provided on the rotor housing 12 and the other element 86 is provided on the cover 80 or on the lid 85. In the same way, the recess 84 can also be provided in the lid 85 instead of the cover 80.

The stop 8 and the guide bolt 15 guarantee a perfect seal between the two parts 40 and 41 of the fiber feed channel 4 and also fastening relative to the rotor housing 12.

So that the lid 85 with the movable part 41 of the fiber feed channel 4 can be brought into an ideal position both relative to the rotor housing 12 and relative to the stationary part 40 of the fiber feed channel 4, the lid 85 is adjustable on the cover 80 in a way not shown.

In contrast to the embodiment illustrated in FIG. 2, an advantageous design of the sealed-off divided fiber feed channel 4 is also obtained if the pivot axle 81 for the cover, extending parallel to the collecting-groove plane 14, is arranged above the open-end spinning apparatus instead of below it.

As is evident from FIG. 3, the parting face 6 is arranged at an inclined angle $\alpha$ relative to the direction of movement (double arrow 7) of the movable part 41 of the fiber feed channel 4 in the region of the parting face 6. During the closing movement, the lid 85, together with the part 41 of the fiber feed channel 4, only reaches the O-ring 60 in the last phase of its movement, whereas, during the opening movement, it is in contact with the O-ring 60 only in the very first phase of this movement.

Because the O-ring 60 is designed in the way described, the angle of inclination (angle $\alpha$) can even differ from a right angle to a considerable extent. It has been shown that sliding movements can be prevented if the angle $\alpha$ is greater than 5°. This angle $\alpha$ is selected so that the movable part 41 of the fiber feed channel 4 executes a movement, the components of which are, as far as possible, perpendicular to the two parting faces to be sealed off.

The two exemplary embodiments show that the divided fiber feed channel 4 described can be used in conjunction with various open-end spinning apparatuses. In addition to the designs which have been explained, further modifications are possible, for example by the interchange of features or by replacing them with equivalents and combinations of these. Thus, if desired, the O-ring 60 can be arranged in the part (housing 30 or 34) receiving the stationary part 40 of the fiber feed channel 4 or, instead, also in the part (cover 5 or 80 or lid 85) receiving the movable part 41 of the fiber feed channel 4. Furthermore, instead of an O-ring 60, an elastic parting face designed in another way, for example in the form of an elastic or elastically mounted plate, can also be provided on one or both of the ends, facing one another, of the parts 40 and 41 of the fiber feed channel 4.

Even in an apparatus according to FIG. 1, the part 41 of the fiber feed channel 4 can be arranged in a part which is adjustable relative to the cover 5, in order to achieve an extremely accurate adjustment of this movable part 41 both relative to the stationary part 40 of the fiber feed channel 4 and relative to the friction-spinning elements 1.

Alternatively, it is also possible, in contrast to the exemplary embodiments illustrated, to pivot the movable part 41 of the fiber feed channel 4 about an axis which is arranged parallel to the axis of the friction-spinning elements 1 or the parting plane between the rotor housing 12 and the lid 85 or parallel to the axis of the fiber feed channel 4. However, the movable part 41 of the fiber feed channel 4 can also be movable linearly or along a curve determined by a guide, instead of being movable over an arc of a circle. In all these cases, it is possible to fix the direction of movement (see the double arrow 7) so that the movable part 41 of the fiber feed channel 4 has, for the duration of contact with the O-ring 60, a movement component which is perpendicular to the parting face 6 passing through the O-ring 60 between the two parts 40 and 41 of the fiber feed channel 4.

We claim:

1. An open-end spinning apparatus, comprising:

a spinning element and housing therefor;

an opening-roller housing;

a fiber feed channel which leads from said opening-roller housing to said spinning element, and which is formed by separable parts including a stationary part and a movable part, and having an elastic parting face between said separable parts;

a movable cover for said spinning element which receives said movable part of said fiber feed channel, and which is pivotally mounted relative said spinning element housing; and a stop, comprising two interacting elements, one element being associated with said cover and the other element being associated with said spinning element housing, for properly positioning said cover when closed relative said spinning element; wherein said elastic parting face is arranged at a predetermined minimum angle ($\alpha$) relative to the direction of movement of said movable part of said fiber feed channel received by said cover such that contact of said movable part with said parting face is in a direction substantially perpendicular to said parting face so as to reduce sliding contact therebetween.

2. An apparatus as in claim 1, wherein said parting face includes an elastic O-ring which contacts and seals said separable parts whenever same are brought together by the closure of said cover.

3. An apparatus as in claim 2, wherein said O-ring is provided on said stationary part of said fiber feed channel.

4. An apparatus as in claim 2, wherein said O-ring is provided on said movable part of said fiber feed channel.

5. An apparatus as in claim 1, wherein said predetermined minimum angle ($\alpha$) is at least 5°.

6. An apparatus as in claim 5, wherein said predetermined angle ($\alpha$) is less than 45°.

7. An apparatus as in claim 1, wherein said open-end spinning apparatus is of the type having a spinning rotor defining a collecting groove, and wherein said cover is pivotable about a pivot axis which extends horizontally in a plane parallel to the collecting-groove plane of said spinning rotor.

8. An apparatus as in claim 7, further including a guide bolt associated with said cover, which aligns said movable part of said fiber feed channel during its movement into a working, closed position in contact with said parting face, such alignment being relative to said stationary part and parallel to said pivot axis of of said cover.

9. An apparatus as in claim 8, wherein at least one of said stop and said guide bolt is located at an end of the surface of said cover in contact with said spinning element housing which is turned away from said parting face.

10. An apparatus as in claim 7, wherein said cover is pivotable about a pivot axis which is located in the plane of said parting face of said fiber feed channel, to thereby prevent movement components of said cover and said movable part from being parallel to said parting face.

11. An apparatus as in claim 1, wherein said open-end spinning apparatus is of the type having two drive friction-spinning elements forming a V-shaped nip, and wherein said cover is pivotable about a pivot axis which extends perpendicularly relative to the axes of the friction-spinning elements and parallel to the plane passing through such axes of the two friction elements.

12. An apparatus as in claim 11, wherein said cover is pivotable about a pivot axis which is located in the plane of said parting face of said fiber feed channel, to thereby prevent movement components of said cover and said movable part from being parallel to said parting face.

13. An apparatus as in claim 11, further including a guide bolt associated with said cover, which aligns said movable part of said fiber feed channel during its movememnt into a working, closed position in contact with said parting face, such alignment being relative to said stationary part and parallel to said pivot axis of said cover.

14. An apparatus as in claim 1, wherein said cover is pivotable about a pivot axis which is located in the plane of said parting face of the said fiber feed channel, to thereby prevent movement components of said cover and said movable part from being parallel to said parting face.

15. An apparatus as in claim 14, further including a guide bolt associated with said cover, which aligns said movable part of said fiber feed channel during its movement into a working, closed position in contact with said parting face, such alignment being relative to said stationary part and parallel to said pivot axis of said cover.

16. An apparatus as in claim 1, wherein said stop is located at an end of the surface of said cover in contact with said spinning element housing which is turned away from said parting face.

17. An apparatus as in claim 1, wherein said predetermined minimum angle ($\alpha$) is in the range of 5° to 90°.

* * * * *